United States Patent [19]

Malhotra

[11] Patent Number: 4,614,171

[45] Date of Patent: Sep. 30, 1986

[54] ROCKER ARM CONSTRUCTION

[75] Inventor: Shashi Malhotra, River Edge, N.J.

[73] Assignee: W H Industries Inc., Northvale, N.J.

[21] Appl. No.: 751,965

[22] Filed: Jul. 5, 1985

[51] Int. Cl.[4] ..... F01L 1/18

[52] U.S. Cl. ..... 123/90.44; 123/90.36; 123/90.27; 123/90.39

[58] Field of Search ..... 123/90.27, 90.33, 90.36, 123/90.39, 90.44

[56] References Cited

U.S. PATENT DOCUMENTS

| | | | |
|---|---|---|---|
| 1,699,659 | 1/1929 | Fagan | 123/90.39 |
| 2,041,983 | 5/1936 | Van Ranst | 123/90.44 |
| 2,071,051 | 2/1937 | Van Ranst | 123/90.44 |
| 2,322,172 | 6/1943 | Spencer | 123/90.36 |
| 2,322,173 | 6/1943 | Spencer | 123/90.44 |
| 2,322,174 | 6/1943 | Spencer | 123/90.44 |
| 2,385,309 | 9/1945 | Spencer | 123/90.36 |
| 2,435,727 | 2/1948 | Spencer | 123/90.36 |
| 2,905,161 | 9/1959 | Latham | 123/90.39 |
| 2,917,033 | 12/1959 | Brogren | 123/90.39 |
| 3,139,870 | 7/1964 | Sampietro | 123/90.44 |

*Primary Examiner*—Ira S. Lazarus

*Attorney, Agent, or Firm*—Aubrey L. Burgess

[57] ABSTRACT

An improved rocker arm for an internal combustion overhead cam engine, the rocker arm having a cam roller journaled therein on needle bearings and the like, and being so constructed to provide a reservoir for oil to insure continued lubrication of the cam roller.

6 Claims, 3 Drawing Figures

ROCKER ARM CONSTRUCTION

BACKGROUND OF THE INVENTION

1. Field of the Invention

This invention relates to improvements in the construction of rocker arms as used in overhead cam shaft internal combustion engines of modern automobiles. In these applications cam actuated rocker arms engage the valve stems of the intake and exhaust valves and effect reciprocating motion of the stems, thus opening and closing the valves in predetermined sequence.

Rocker arms of the general type being described herein are constructed with a cam roller rotatably mounted on a shaft supported by side walls of the rocker arms and in a slot-like, bottomless and topless opening in the rocker arm. Lubrication of the cam roller is effected by oil splashing therein in a haphazard manner. Premature failure of the cam roller and thus the rocker arm can result from the lack of lubrication, causing malfunction of the valving and requiring replacement of the rocker arm assembly.

2. Description of Prior Art

Spencer, U.S. Pat. No. 2,385,309, describes a valve actuating mechanism in an overhead cam environment which comprises a rocker arm, supported on a pivot pin, having a cam roller recess in its upper part in which a cam roller is rotatably seated. The rocker arm is constructed with various passages for forced lubrication of the cam roller and the valve stem, oil being supplied through the pivot pin to and through the various passages, making the rocker arm very expensive to manufacture. The passages can become clogged in the event of contamination of the oil supply, requiring removal and cleaning and perhaps replacement of the rocker arm.

Sampietro, U.S. Pat. No. 3,139,870, shows an operating arrangement for the valves of cylinders of an internal combustion engine. Each cylinder has four valves and each valve is actuated by a rocker arm; there are at least two types of rocker arms used. One type has a cam roller journaled at its end; the other type has a cam roller journaled centrally thereof. Both rollers engage the same cam. The patent is silent as to the lubrication of the cam rollers.

SUMMARY OF THE INVENTION

According to the invention herein described, an improved rocker arm is provided for an overhead cam internal combustion engine. The improved rocker arm can be described as being shaped like a canoe or bathtub, i.e., one which is elongated with defining side and end walls, a bottom wall and an open top. A cam roller is journaled on a shaft supported by the side walls such that a part of the roller extends above the tops of the rocker arm's defining walls. The rocker arm is pivotably supported at one end on a generally vertical adjustable valve or valve clearance lash member and engages a valve stem at its other end. The lash adjuster is formed with a generally spherical top which is received in a generally spherical shaped socket formed in the rocker arm. The rocker arm has a flat engaging the valve stem. The valve stem is resiliently urged upwardly by means of a coil spring to maintain its engagement with the flat of the rocker arm.

The cam roller engages a cam on the cam shaft of the engine, usually driven at half speed of the crank shaft through gearing, a chain-sprocket arrangement or through a belt-pulley arrangement. Each cylinder of the engine has at least two valves, an intake valve and an exhaust valve, and each is actuated by a cam-actuated rocker arm in a predetermined sequence. Because the operation of the engine valves are well known in the art, it will not be further described.

Each cam roller of this invention is provided with anti-friction means, preferably in the form of needle bearings surrounding its shaft; however, other types of anti-friction means can be used, such as "Teflon" cloth, lining the roller.

The rocker arms, because of their construction act as reservoirs for oil and insure the continued lubrication of the cam rollers, the anti-friction means and insure long operating life to the assembly of cam rollers and rocker arms.

An opening can be formed in the bottom of the rocker arm for oil to pass onto the associated valve stem; however, the position of the opening is chosen such that the oil level in the rocker arm will be sufficient to insure continued lubrication of the cam roller and its anti-friction means.

DESCRIPTION OF THE PREFERRED EMBODIMENT

Figure 1:
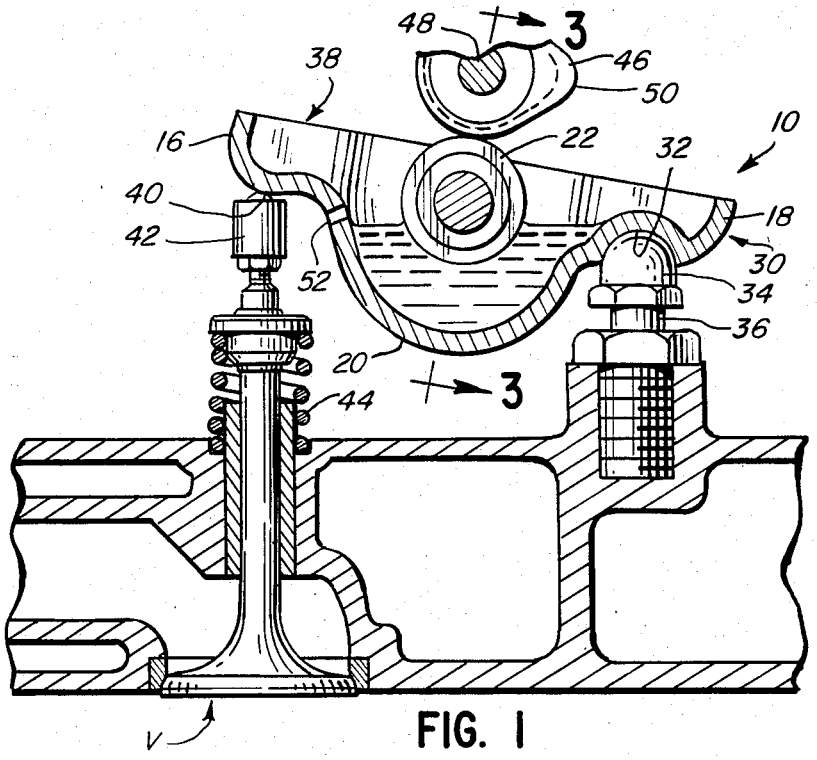
FIG. 1 is a perspective illustration of the construction of the rocker arm and cam roller assembly of this invention.
Figure 2:
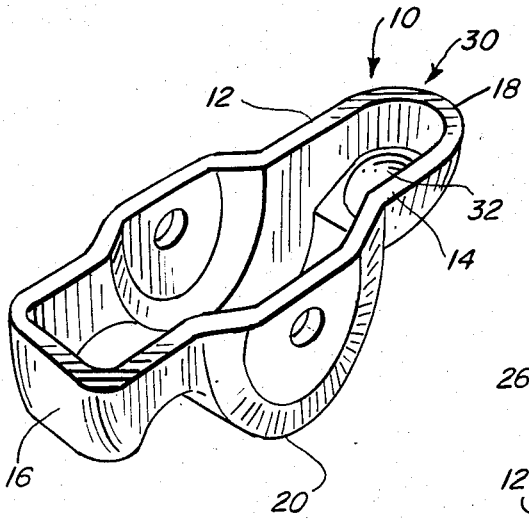
FIG. 2 is a cross-sectional view taken on line 2—2 of FIG. 1.

Looking now at the drawings, the rocker arm of this invention is elongated and identified as 10, and comprises side walls 12 and 14, end walls 16 and 18, and a bottom wall 20. The rocker arm resembles a canoe or bathtub because of its shape and its open top. A cam roller 22 is journaled in the rocker arm 10 on needle bearings 24 by shaft 26, the latter being supported by the side walls 12 and 14. Thrust washers 28 flank the sides of the roller 22 to absorb any side-wise thrust encountered. One end 30 of the rocker arm 10 is provided with a spherical socket 32 which receives a complementary-shaped end 34 of a height adjustable lash adjuster 36 (see FIG. 3). The other end 38 of the rocker arm 10 is provided with a flat 40 to engage the top of a valve stem 42, the valve stem being resiliently urged upwardly into engagement with the flat by a coil spring 44. The cam roller 22 engages a cam 46 fixed on a rotatable cam shaft 48. As the cam shaft rotates, the cam also rotates and when the elongated cam part 50 contacts the cam roller, the rocker arm is caused to pivot at the socket 32, which in turn moves the valve stem 42 downwardly against the spring 44, thus opening the valve V. As will be understood, as the cam shaft rotates, the cams, usually two for each cylinder, sequentially open and close the valves of the engine, permitting the flow of fuel into and the exhaust of products of combustion from the cylinders.

The particular construction of the rocker arm permits it to retain oil; the construction permits the rocker arm to function as a reservoir for oil, insuring continued lubrication of the cam rollers. Generally sufficient oil is provided by oil; splashing from the engine crankcase; however, an initial supply of oil can be provided and replenished periodically if necessary.

Figure 3:
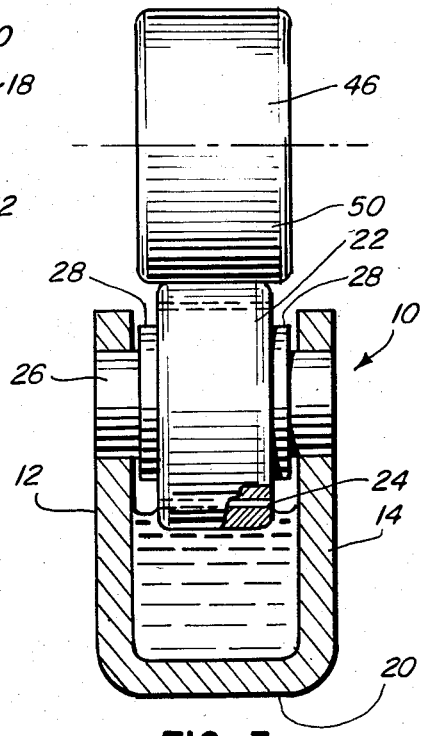
FIG. 3 is a longitudinal cross-sectional view of the rocker arm and cam roller assembly of this invention showing schematically the environment in which the rocker arm and cam roller assembly is used.

As shown in FIG. 3, a passage 52 can be provided in the bottom of the rocker arm for oil to be supplied to the valve stem. The location of the passage 52 is such that the oil level in the reservoir is sufficient to insure continued lubrication of the cam roller journal.

The rocker arm is generally a metal stamping and is thus economical to manufacture; the cam roller is generally a machined metal part.

The appended claims are intended to cover all reasonable equivalents of the structure.

I claim:

1. A rocker arm for an internal combustion engine, said rocker arm mounting thereon a concentrically mounted cam roller engaging and rotating with a cam on the rotatable cam shaft of the engine, said rocker arm being elongated and having side and end walls and a bottom wall, and comprising an open, generally flat-topped tub-like container, one end of said rocker arm being provided with a generally concave semi-spherical depression, so as to be supported on a complementary shaped semi-spherical member at a fixed height, and the other end of which engages the stem of a valve of said engine, said rocker arm being pivotable about its fixed height end by means of said cam engaging the cam roller to thus operate the valve, said rocker arm functioning as a reservoir for oil in which said cam roller rotates, said cam roller being rotatably mounted on a roller shaft journaled in circular openings in the side walls of said rocker arm and having anti-friction means comprising needle bearings surrounding its supporting shaft.

2. In an internal combustion engine having a cylinder head and combustion chambers, an input port and an exhaust port opening into each chamber, a spring loaded poppet valve controlling the flow of gas to and from each combustion chamber, a cam being so constructed and arranged to operate each valve in a predetermined sequence, a cam shaft driven from said engine and having cams mounted thereon, a concentrically mounted cam roller engaged by its respective cam, each cam roller being rotatably mounted in a rocker arm, each rocker arm being tub-like and having a body portion and a pair of extending portions defining a generally flat top container, circular openings in said rocker arm providing journals for said cam roller shaft, means supporting one of said extending portions at a fixed location, said means comprising a generally semi-spherical member engaging a complementary depression in said rocker arm, the other extending portion engaging the stem of a poppet valve, whereby each cam engaging its cam roller operates a valve in a predetermined sequence, said rocker arm being so constructed and arranged to function as a reservoir for oil such that said cam roller rotates in a bath of oil.

3. In an internal combustion engine as recited in claim 2, further comprising a passageway in one extending portion of said rocker arm for the passage of oil onto its valve stem.

4. A rocker arm assembly for an internal combustion engine and a mounting for said assembly which comprises:

a substantially vertical shaft terminating in a generally semi-spherical shaft member;

a rocker arm having a body portion and protruding arms, one arm of which is provided with a depression complementary shaped to said shaft member so as to support said rocker arm at one end while permitting pivoting movement of said rocker arm about said shaft member, the other arm of said rocker arm contacting and activating a valve stem;

means resiliently urging said valve stem toward said rocker arm;

a tub-like chamber formed by the body and arms of said rocker arm;

a cam roller concentrically mounted on anti-friction means, supported on a shaft journaled in said body portion and located in said chamber, said shaft traversing said chamber;

a cam engaging said roller and causing said pivotable movement of the rocker arm in relation to said vertical shaft and said shaft member to thus activate said valve stem.

5. A rocker arm assembly as recited in claim 4, further comprising an opening in said body portion, said opening being so constructed and arranged to supply oil from said reservoir to said valve stem.

6. A rocker arm assembly as recited in claim 4, wherein said anti-friction means comprises needle bearings.

* * * * *